United States Patent [19]

Stahlecker et al.

[11] Patent Number: 4,805,395

[45] Date of Patent: Feb. 21, 1989

[54] OPENING ROLLER FOR AN OPENING DEVICE OF AN OPEN-END SPINNING MACHINE

[75] Inventors: Fritz Stahlecker, Josef-Neidhart-Strasse 18, 7347 Bad Uberkingen; Hans Stahlecker, Haldenstrasse 20, 7334 Sussen; Gerhard Fetzer, 7334 Sussen; Eugen Bader, Birenbach, all of Fed. Rep. of Germany

[73] Assignees: Fritz Stahlecker; Hans Stahlecker, both of Fed. Rep. of Germany

[21] Appl. No.: 191,402

[22] Filed: May 9, 1988

Related U.S. Application Data

[63] Continuation-in-part of Ser. No. 793,122, Oct. 30, 1985, abandoned.

[30] Foreign Application Priority Data

Oct. 30, 1984 [DE] Fed. Rep. of Germany ..... 3439664
Apr. 26, 1985 [DE] Fed. Rep. of Germany ..... 3515153

[51] Int. Cl.[4] ..... D01H 7/892; D01H 7/895; D01G 15/84; D01G 19/10

[52] U.S. Cl. ..... 57/408; 19/97; 19/112; 19/114; 57/404

[58] Field of Search ..... 57/400, 404, 408–411; 19/82, 83, 97, 98, 99, 108, 112, 114

[56] References Cited

U.S. PATENT DOCUMENTS

| | | | |
|---|---|---|---|
| 3,136,005 | 6/1964 | Reiterer | 19/112 X |
| 3,204,297 | 9/1965 | Wada | 19/114 |
| 3,391,429 | 7/1968 | Watanabe | 19/114 |
| 4,044,427 | 8/1977 | Ankrom et al. | 19/112 X |
| 4,296,527 | 10/1981 | Eadie | 57/408 X |
| 4,300,265 | 11/1981 | Heinen | 19/112 |
| 4,339,851 | 7/1982 | Schmolke | 19/97 |
| 4,342,137 | 8/1982 | Ennis et al. | 19/112 X |
| 4,398,318 | 8/1983 | Ashworth, III | 19/114 |
| 4,435,953 | 3/1984 | Schmid et al. | 57/408 |
| 4,574,583 | 3/1986 | Stahlecker et al. | 57/408 |

*Primary Examiner*—John Petrakes
*Attorney, Agent, or Firm*—Barnes & Thornburg

[57] ABSTRACT

An opening assembly for an open-end spinning arrangement is provided which includes a steel alloy fitting ring element arranged on a rotatable roller body element for opening a silver into individual fibers. The fitting ring element includes a base wall having a radial thickness no greater than 2.2 mm, and includes a plurality of radially extended teeth unitary with the fitting ring element extending from the base wall. The teeth have lateral flanks formed by at least one cirumferential groove on an outer surface of the fitting ring element, and have front and back edges formed by at least two axially extending longitudinal grooves. The front and back edges have a radial height of about 0.75–0.80 times a radial height of the lateral flanks. The base wall radial thickness has a dimension of about 0.60–0.72 times the radial height of the lateral flanks. The height of the teeth is greater than the distance between the lateral flanks of axially adjacent teeth. The teeth are inclined toward a rotational direction. The teeth have an angle between the front and back edges between about 15° to 45°.

26 Claims, 4 Drawing Sheets

OPENING ROLLER FOR AN OPENING DEVICE OF AN OPEN-END SPINNING MACHINE

CROSS REFERENCE TO RELATED APPLICATION

This application is a continuation-in-part application of U.S. patent application Ser. No. 793,122, filed Oct. 30, 1985, now abandoned.

BACKGROUND AND SUMMARY OF THE INVENTION

This invention relates generally to an opening roller for an opening device of an open-end spinning machine having a roller body that is connected to a shaft, a fitting ring being arranged on the roller body. The fitting ring is equipped on its circumference with teeth which are integral with the fitting ring by forming in the ring at least one surrounding groove and several recesses extending essentially in the axial direction.

In the case of known opening rollers that are presently employed in open-end spinning machines, the teeth comprise a saw-tooth wire wound directly onto the roller body or onto a fitting ring mounted on the roller body. The shape of the teeth which has a considerable influence on the effectiveness of the opening of a sliver is adapted to the fiber material to be processed. In order to protect the relatively fine teeth against mechanical damage during handling, transport or storage, collars are conventionally provided laterally of the teeth. These collars are being made in one piece with the component carrying the teeth; i.e., with the fitting ring or the roller body.

An opening roller of the initially mentioned type is known (DE-OS 19 39 683), wherein a fitting ring is provided with integral teeth shaped by working in at least one surrounding groove and several recesses extending in the axial direction. This fitting ring extends outward beyond the roller body on both sides in the axial direction. Because of the axially extending recesses, it is not possible with this construction to mount collars at the fitting ring which can protect the teeth during the handling, the transport or the storage from mechanical damage. In this construction, the teeth must therefore be designed to be very stable so that the possible shapes of the teeth are very limited. An obtuse vertical and opposite angle is provided between the tooth face and the back of the tooth. In addition, the height of the tooth is relatively low; i.e., it is smaller than the axial separation of the teeth. Opening rollers of this type have not been used in practice.

Saw-tooth wire for card clothing is shown in U.S. Pat. No. 3,391,429 to Watanabe. Card clothing machines are used for an entirely different purpose than opening rollers, and produce a completely different product after processing. Specifically, card clothing machines are used for forming slivers, as opposed to opening rollers which are used to actually open up slivers. Thus, opening rollers produce individual fibers opened up from a sliver, while carding machines produce slivers. The carding machine product or the sliver is actually the initial material treated by an opening roller to produce opened up fibers. As these functions are quite diverse and produce completely different results, the dimensions and shapes shown in Watanabe for a card clothing machine would not suggest similar dimensions and shapes for use in an opening roller.

Further, a solid ring is less complicated to use than saw-tooth wire. Saw-tooth wire often needs to be applied to a support ring prior to application to a roller body. In the past, aluminum materials have been used for saw-tooth wires and supporting cylinders, and thus the size of the structures has not been a factor as the aluminum is relatively light in weight. Steel is a stronger and more durable material which is needed for opening rollers. However, the steel is a heavier material than aluminum, and thus total mass should be kept at a minimum. Therefore, the reduction of the size of the ring thickness is highly desirable.

In solid rings, the thickness of the ring portion below the teeth can be kept minimal as an additinal supporting ring is not required underneath to support windings of the saw-tooth wire.

For example, U.S. Pats. Nos. 4,339,851 and 4,342,137 show open-end rolling arrangements which utilize saw-tooth wire. In these arrangements, a supporting ring or body is required to support the windings of saw-tooth wire in addition to the saw-tooth wire itself.

Further, the dimensions of the opening roller ring and teeth arrangement are highly critical for the specific purpose of opening up slivers into individual fibers. The individual fibers are subsequently spun into yarn, and thus these fibers should not be damaged when opened-up from the sliver.

An object of the present invention is to provide an opening roller of the initially mentioned type which is not subject to limitations with respect to the development and design of the teeth. Another object of the present invention is to provide an opening roller having tooth shapes and dimensions which are advantageous for the specific function of opening up slivers into individual fibers for the particular fiber materials desired to be spun.

It is a further object of the present invention to provide a durable tooth ring which provides prolonged, efficient and effective opening up of fibers without damage to the fibers, but which also remains light in weight.

These and other objects are achieved by providing an opening assembly for an open-end spinning arrangement which includes a steel alloy fitting ring element arranged on a rotatable roller body element for opening a sliver. The fitting ring element includes a base wall having a radial thickness of no greater than 2.2 mm, and includes a plurality of radially extended teeth unitary with the fitting ring element extending from the base wall. The teeth have lateral flanks formed by at least one circumferential groove on an outer surface of the fitting ring element, and have front and back edges formed by at least two axially extending longitudinal or axial grooves. The front and back edges have a radial height of about 0.75–0.80 times a radial height of the lateral flanks. The base wall radial thickness has a dimension of about 0.60–0.72 times the radial height of the lateral flanks. The height of the teeth is greater than the distance between the lateral flanks of axially adjacent teeth. The teeth are inclined toward a rotational direction. The teeth have an angle between the front and back edges between about 15° to 45°.

These dimensions and the steel alloy material provide a superior fitting ring element for use in opening up slivers into individual fibers. The steel alloy ring element provides superior wear resistance, and also facilitates uniform application of resistant coatings according to certain preferred embodiments, because the ring element is formed of a single material. The wall thickness of the ring element from which the teeth extend has an optimal thickness which is no greater than 2.2 mm to ensure that the mass of the ring is not too great. The dimensions of the ring are optimal for the purpose of processing a sliver into opened up individual fibers.

As a result of the height of the teeth being larger than their axial dimension, the working surface of the teeth in the fiber material can be increased so that the opening roller is more efficient.

According to other advantageous features of certain preferred embodiments of the invention, the height of the teeth is 1.2 to 1.7 times, preferably 1.5 times larger, than the axial dimension. With these dimensions, optimal results are achieved under real conditions during the opening of a sliver.

According to other advantageous features according to certain preferred embodiments of the invention, the base width of the circumferential grooves is approximately 2.5 to 3.5 times greater than an axial width of the base of the teeth. In certain preferred embodiments, the axial base width of the teeth is not greater than 0.7 mm.

According to other advantageous features of certain preferred embodiments of the invention, all edges of the teeth including the front edges, the back edges and the tip portion include a convex rounded edge (convex) having a radius of curvature with respect to a radial plane extending through the teeth. In certain preferred embodiments, this radius of curvature is about 0.02 mm to 0.06 mm, and preferably has a radius of about 0.04 mm. These rounded edges can be created by electrolytical, electrochemical or chemical deburring.

According to other advantageous features of certain preferred embodiments of the invention, the fitting ring element is bordered on the front side by collars extending in the radial direction up to approximately the tips of the teeth. At least one of the colars is shaped onto a component that is independently produced and mounted onto the roller body and/or the fitting ring element.

By means of these embodiments, it is achieved that, despite the mounting of axial recesses at the fitting ring element, collars may be provided which protect the teeth from mechanical damage during handling or transport or similar processes. It is therefore possible to employ finely shaped teeth.

In other advantageous features of certain preferred embodiments of the present invention, it is provided that the angle between the front and back edges of the teeth is about 20° to 33°. In these embodiments, a tooth shape is created which can be used especially in the short staple area for almost all fiber materials.

According to other advantageous features of certain preferred embodiments of the invention, it is provided that the teeth have a tooth face angle which, in the area of the tip of the teeth, is 12° to 25°. As a result, tooth shapes are obtained which permit a good opening of a sliver because of the slope in the rotational direction.

According to other advantageous features of certain preferred embodiments of the invention, it is provided that the front tooth face, as viewed in axial direction, has a continuous concave arch. In the case of the previously customary saw-tooth wires, such a tooth shape cannot be realized for manufacturing reasons since, because of the small separation of the successive teeth, the radius at the base of the tooth could no longer be pressed to be sufficiently round. When the teeth are worked into a fitting ring, especially by means of a grinding process, such a radius at the tooth face and at the base of the tooth does not prevent such problems. Therefore, it is possible to provide the concave arching at the tooth face which offers considerable advantages for the opening of a sliver.

In practive, it was found that in the case of teeth with a straight, sloped tooth face, the fibers have the tendency to move into the area of the base of the tooth, where the fibers cause notches to be formed in the teeth. This could not be avoided because the saw-tooth wires to be wound on could not be hardened sufficiently in the area of the bases of the teeth. By means of the concave arching of the face of the teeth in certain preferred embodiments, the fibers processed by the teeth are forced to glide on the teeth more toward the tip of the tooth which is advantageous for opening. It is therefore possible more than previously to utilize the total height of the teeth for the opening. In certain preferred embodiments, it is especially advantageous if the radius of the concave arching of the tooth face of the teeth decreased continuously from the tip of the tooth to the base of the tooth.

According to other advantageous features of certain preferred embodiments of the invention, it is provided that the collars form a premountable structural unit with the fitting ring element. This, on the one hand, results in the advantage that the roller body does not require receiving means or shapings for the collars, so that the manufacturing of the roller body, which often takes place essentially by machining, can be simplified and made cheaper. On the other hand, the advantage is achieved that the separately manufactured fitting ring element is already equipped with the protection of the teeth provided by the collars so that damaging during the transport, replacing process, handling or similar process involving the fitting ring element is avoided.

According to other advantageous features of certain preferred embodiments of the invention, it is provided that the fitting ring element is fastened on a sleeve having collars. The sleeve is detachably mounted at the roller body. In these embodiments, in the manufacturing plant, the fitting ring can be connected with the sleeve so that during the mounting on the roller body taking place during the exchange at the usage site, it is not subjected to any mounting forces which could result in a deformation and/or damaging of the teeth. In certain preferred embodiments, the sleeve is made in one piece with one collar, and a second collar is fitted onto the sleeve.

According to other advantageous features of certain preferred embodiments of the invention, it is provided that the fitting ring is equipped with axial recesses projecting axially and/or radially over the roller body into which the collars are inserted. In certain preferred embodiments, the collars are equipped with the sleeve-shaped projections used for insertion into the axial recesses. As a result, the collars can be fastened directly at the fitting ring which does not influence the design of the roller body itself. In certain preferred embodiments, it is especially advantageous if the collars with the projections are constructed as sheet metal preforms. Such sheet metal preforms can be manufactured, for example, by pressing and/or drawing in a simple and reasonable manner.

According to other advantageous features of certain preferred embodiments of the invention, it is provided that the fitting ring is made of steel alloy material hardened to a hardness of approximately HRc 60+c. The teeth that are shpaed onto the fitting ring in one piece therefore have the same hardness over their whole height resulting in a much more favorable wear characteristics than in the case of the previously used opening roller having saw-tooth wires, where the teeth could not be hardened sufficiently in the area of the bases of the teeth.

According to other advantageous features of certain preferred embodiments of the invention, it is provided that the fitting ring, at least in the area of the teeth, it is provided with a surface coating. Since the fitting is constructed in one piece with the teeth, and thus is made of the same material as the teeth, a wide variety of coatings may be applied by means of correspondingly varied coating processes. In particular, a coating may also be applied at an elevated temperature, especially at temperatures of more than 800° C. These coatings can include wear resistant coatings. The coatings are preferably applied to the already hardened fitting ring because the teeth will then have an increased stability with respect to mechanical deformation. A titanium carbide coating may, for example, be selected which permits pyramid hardnesses of 3,200. Similarly high values can be achieved using a titanium nitride coating.

In the case of another embodiment, it is provided that the fitting ring is treated with boron after a hardening. As a result, pyramid hardnesses of about 2,500 can be reached.

Other objects, advantages and novel features of the present invention will become apparent from the following detailed description of the invention when considered in conjunction with the accompanying drawings.

DETAILED DESCRIPTION OF THE DRAWINGS

Figure 1:
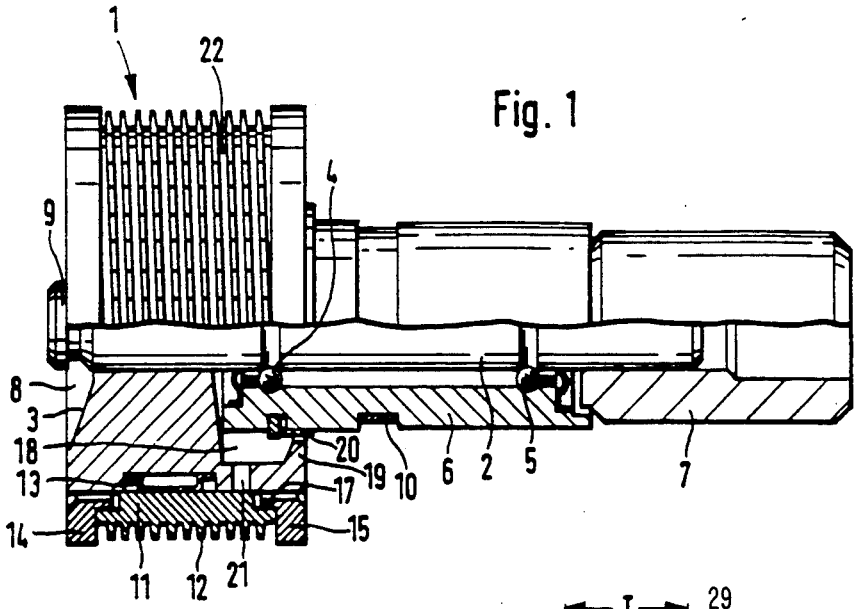
FIG. 1 is a side view of an opening roller that is axially cut in half and has a roller body connected to a shaft and a fitting ring with collars arranged on it in accordance with the present invention.

The opening roller shown in FIG. 1 is intended for use in an open-end spinning unit. It is driven at speeds of between 5,000 and 12,000 rotations per minute, and has the purpose of combing out and opening up into individual fibers a sliver that is fed to it by a feeding device that it not shown.

The opening roller 1 according to FIG. 1 has a shaft 2 on which a roller body 3 is arranged in a rotationally stable manner. The shaft 2, by means of two roller bearings 4 and 5, is disposed in a cylindrical bearing housing 6 which has stop shoulders for the balls of the roller bearings 4 and 5. The shaft 2, with both ends, projects beyond the bearing housing 6. One projecting end is equipped with a pressed-on wharve 7 via which the shaft 2 (in a manner not shown) is driven by a belt. The roller body 3 is arranged on the other end of the shaft 2 that projects out of the bearing housing 6. The roller body 3 is also pressed onto the shaft 2. On its exterior front side, the roller body 3 has a conical depression 8 into which the end of the shaft 2, provided with a collar 9, projects. The collar 9 is used as a working surface for a tool by means of which the whole opening roller 1, i.e,. including the shaft 2 and the bearing housing 6, can be pulled out of a bearing of a spinning unit. The bearing housing 6 is equipped with a plastic ring 10 arranged in a ring groove, a fastening element (not shown) engaging the plastic ring 10. The fastening element thus secures the opening roller 1 in its bearing seat in the axial direction.

The roller body 3, by means of an axial projection, laps over the end of the bearing housing 6 facing it, at a distance, so that a surrounding hollow space 18 is created. This hollow space 18 is delimited by a ring-shaped projection 19 located at the projection of the roller body 3 and projecting toward the inside. The projection 19 is disposed adjacent a ring-shaped insert 20 of the bearing housing 6 and forms a sealing gap with it. The insert 20 is held by a retaining ring. Several radial bores 21 leading to the hollow space 18 are provided in the area of the projection overlapping the bearing housing 6. The radial bores 21 are covered by a fitting ring 11, after the removal of which the radial bores 21 are accessible so that the hollow space 18 can be cleaned, for example, by applying a compressed-air nozzle to the bores 21.

By means of a cylindrical bore, the fitting ring 11 is pushed onto the cylindrical outer circumference of the roller body 3. At its circumference, the roller body 3 has a ring groove into which a spring band 13 is placed. The band 13 is elastically deformed when the fitting ring 11 is pushed on the roller body and the spring band secures the fitting ring 11 on the roller body 3 in the axial direction.

The outer circumference of the fitting ring 11 is provided with teeth 12 which cause the combing-out and opening up of a sliver into individual fibers. In the axial direction, the fitting ring 11 is delimited by two collars 14 and 15 which extend slightly beyond the height of the teeth 12 in the radial direction. The collars 14 and 15, which are constructed as separate structural components, have sleeve-shaped projections 17 by means of which they, in each case, engage in front-side recesses of the fitting ring 11. THe recesses of the fitting ring 11 and the sleeve-shaped projections 17 of the collars 14 and 15 are dimensioned such that the projections 17 do not touch the roller body 3. The sleeve-shaped projections 17 are fitted into the recesses of the fitting ring 11 with a press fit so that a frictional connection is provided.

In a contemplated modification of the embodiments according to FIG. 1, it is possible to mount corresponding collars on the roller bodies 3. In this case, the seats for the projections of the collars are stepped with respect to the cylindrical exterior surfaces intended for receiving the fitting ring 11.

Figure 4:
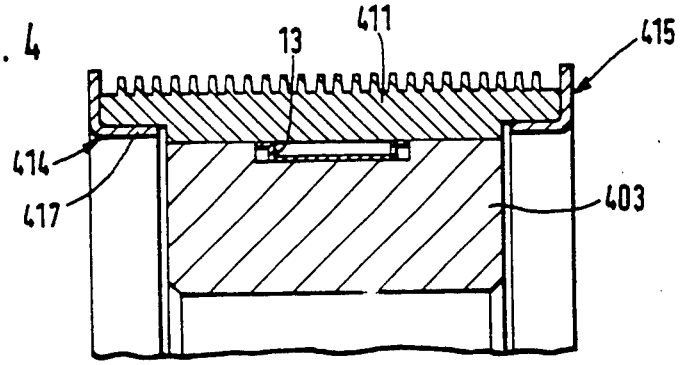
FIG. 4 is a partial sectional view of an opening roller having a fitting ring equipped with collars in accordance with other embodiments of the present invention.

In the case of the embodiments according to FIG. 4, a fitting ring 411 corresponding to the embodiment according to FIG. 1 is mounted in a rotationally stable manner on a roller body 403 by means of a spring band 13 that is inserted in a surrounding groove in the roller body. The edges of the fitting ring 411 project beyond the roller body 403 on both sides in the axial direction. The projection area formed has a larger inside diameter than the diameter of the roller body. Collars 414 and 415 having cylindrical projections 417 are pressed into this area. The collars 414 and 415 are drawn and pressed as sheet metal preforms out of a sheet metal blank.

Figure 5:
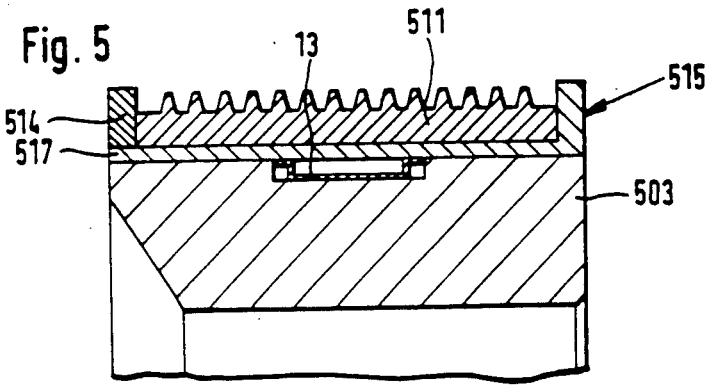
FIG. 5 is a partial sectional view of a fitting ring mounted on a sleeve which is fastened to the roller body in accordance with other embodiments of the present invention.

In the case of the embodiments according to FIG. 5, a fitting ring 511 is arranged on a sleeve 517 which, at one end, is equipped with a flange-type collar 515. The sleeve 517, with its other end, projects over the fitting ring 511 and is equipped with a pressed-on ring 514 which serves as a collar there. In this embodiment, the fitting ring 511, in a rotationally stable manner, is connected with the sleeve 517 which itself is pushed onto the roller body 503 and is secured by a spring band 13 inserted in a surrounding ring groove.

In the embodiments according to FIGS. 1, 4 and 5, the collars which are independently constructed structural components, in each case, form a premountable structural unit with the fitting ring.

In the case of all embodiments, the teeth 12 are constructed integrally with the fittings rings 11, 411 and 511. The fitting rings 11, 411 and 511 are cylindrical basic bodies, the outer circumference of which was machined such that the teeth 12 were formed. In the following, the machining is explained in detail only for the embodiments according to FIGS. 1 to 3. It is also contemplated to apply the same machining methods to the embodiments according to FIGS. 4, 5 and 6. The basic body forming the fitting ring 11 and the teeth 12 is made of a suitable normally hardenable steel alloy. The preferred material is an alloyed steel that can be hardened to values of approximately HRc 60+3.

Figure 2:
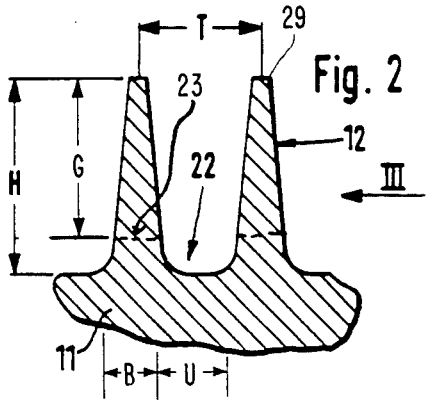
FIG. 2 is an enlarged partial section through the fitting ring of FIG. 1.
Figure 3:
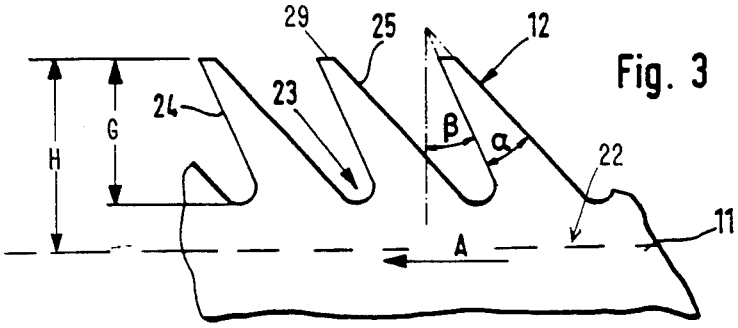
FIG. 3 is a partial view of the teeth in the direction of the arrow III of FIG. 2.

For constructing the teeth 12, a surrounding, circumferential spiral groove 22 is first worked into the outer circumference of the basic body of the fitting ring 11. As a contemplated modification of the shown embodiment, it is provided that several circumferential spiral grooves are worked into the circumference, which preferably are aligned so that they slant in opposing directions. The surrounding circumferential groove or grooves 22 preferably have a V-shaped or trapezoidal cross-section. The circumferential grooves 22 delimit the lateral surfaces (lateral flanks) of the produced teeth 12. In addition, recesses (axial grooves) 23 are worked into the exterior side of the basic body forming the fitting ring 11. These axial grooves 23 are directed essentially in the axial direction relative to the basic fitting ring body and cut across the circumferential grooves. The axial grooves 23 delimit the front faces (edges) 24 and the rear faces (edges) 25 of the teeth 12 (FIGS. 2 and 3).

The front faces 24 are in advance of the rear faces 25 in the rotating direction (arrow A). In certain preferred embodiments, the circumferential spiral groove 22 (or grooves) are worked into the basic body of the fitting ring 11 after hardening the steel alloy. This working-in takes place by grinding or by turning or cutting followed by grinding so that additional polishing is unnecessary. It was determined that with the very fine teeth of the present invention, hardening should be done prior to forming the circumferential groove 22 as a subsequent hardening process may deform the finely formed webs or ribs formed by the circumferential grooves.

After forming the circumferential grooves 22, the axial grooves 23 are ground into the exterior side of the basic body of the fitting ring 11 so that the front faces 24 and the rear faces 25 of the teeth 12 are created. The grinding-in of the axial grooves 23 after the hardening has the advantage that a good concentricity of the fitting ring 11, and thus of the whole opening roller 1, is maintained. In most cases, a subsequent balancing is therefore not necessary. Further, it was found that grinding of the axial grooves was most advantageous as other forming processes may damage the fine webs or ribs which the axial grooves are cut across. Also, grinding provides the most precise forming of the teeth having the specific dimensions and shapes advantageous for opening up a sliver into individual fibers.

After the grinding-in of the axial grooves 23, the fitting ring 11 is treated electrolyticaly or chemically in order to deburr the teeth 12. In certain preferred embodiments, this electrolytical or chemical process is used to slightly round the front faces 24, the back faces 25 and the tip portion 29 of the teeth (all outer edges). This electrolytical or chemical process cuts off sharp edges which form when the circumferential and axial grooves are formed. Thus, this step is more than merely a removal of any burrs which have formed.

Figure 9:
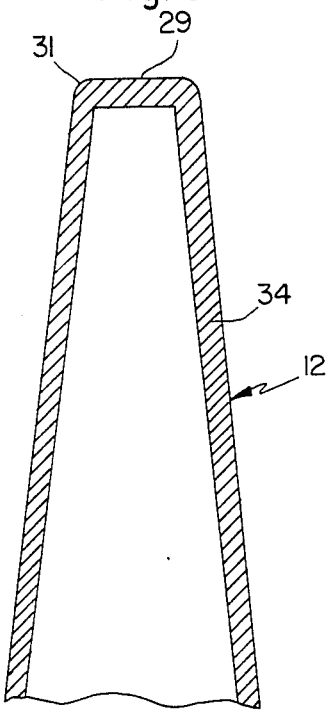
FIGS. 9–11 show magnified front, side and top views respectively of the rounded portions of teeth according to certain preferred embodiments of the invention.
Figure 11:
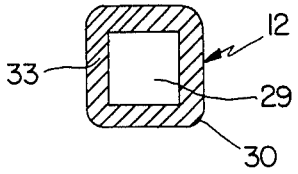
Figure 10:
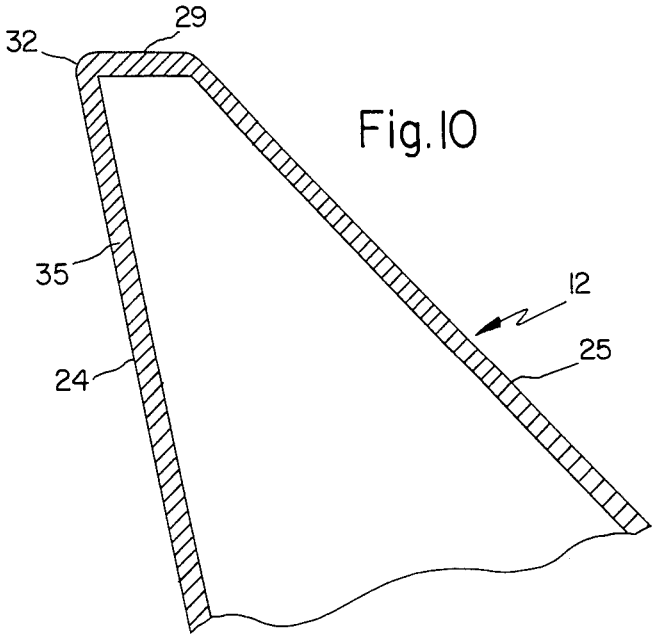

This rounding is shown magnified in FIGS. 9–11. This rounding of the edges 30, 31, 32, 34 and 35 is especially advantageous to prevent damage to fibers and improve the operation of the opening ring assembly. In certain preferred embodiments, the radius of curvature of these rounded edges with respect to a plane extending through the middle of the teeth in radial direction is approximately 0.02 mm to 0.06 mm, and preferably 0.04 mm.

In addition to the hardening of the steel alloy teeth, it is contemplated according to certain advantageous embodiments, especially when the opening roller 1 is intended for the processing of a very tough fiber material such as a mixture of cotton fibers and synthetic fibers, to protect the teeth 12 and the base of the groove from wear by a surface treatment. Preferably, a treatment with boron is provided. Another suitable coating process includes a diffusion carburizing with nitrogen and carbon. Since the teeth 12 as well as the gaps between the teeth are made of the same material, no basic difficulties occur when the coating is applied. Coating processes may therefore be selected which were not possible with opening rollers having an aluminum body and wound-on saw-tooth wires.

As shown in FIGS. 2 and 3, the teeth 12 are made with very fine tips 29 and in slender shapes. The tops (tips) are flattened. The height H of the teeth from circumferential groove 22 base to the tip 29 is large; i.e., larger than the axial separation T between adjacent teeth 12. An acute vertical and opposite angle $\alpha$ is selected which is preferably in a range of 15° to 45°. The vertical and opposite angle $\alpha$ is the angle between the front faces 24 and the rear faces 25. In addition, a relatively large face angle $\beta$ is provided which plays a considerable role for the opening-up of the fiber material. It is contemplated that angle $\beta$ has values between 12° and 25°. The face angle $\beta$ is the angle between a radial surface (a surface perpendicular to the axis and passing through the top point of a tooth) and the front face 24. In the embodiment according to FIG. 3, the front faces 24 extend in a straight line and change in the rear faces 25 with a rounding having a small radius.

The preferred dimensions discussed below provide the optimum opening characteristics for opening up a sliver into individual fibers and most advantageous fitting ring. The base of the teeth at the base of the circumferential grooves 22 should have a thickness B no greater than about 0.7 mm. The width U of the base of the circumferential grooves 22 should be approximately 2.5 to 3.5 times greater in value than the thickness B of the base of the teeth.

Figure 8:
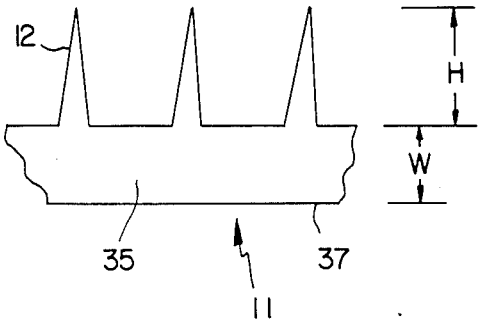
FIG. 8 is a side view of a portion of a fitting ring according to certain preferred embodiments of the invention.

As shown in FIG. 8, the wall 35 of the fitting ring 11 from which the teeth project should have a thickness W of no greater than 2.2 mm. The wall 35 extends from an interior surface 37 of the fitting ring 11 to the base of the circumferential grooves 22. This maximum thickness W of 2.2 mm. is very critical. In the present invention, the fitting ring 11 is made of a hardenable steel alloy to increase resistance to wear and to provide strong supporting material for the finely shaped teeth which are most advantageous for opening slivers into individual fibers. Often, supporting rings in other arrangements have been made of aluminum, and thus dimensions could be larger due to the lightweight aluminum material.

As discussed above, for purposes of resistance to wear, best tooth shape and facilitated coating of a uniform base material, the present invention includes a solid fitting ring made entirely from steel alloy. Thus, the mass of the ring is a concern due to the increased mass of steel alloy with respect to aluminum. To optimally decrease the mass of the ring, it was found advantageous to keep the wall thickness W below 2.2 mm.

As shown in FIG. 8, the ratio of the fitting ring wall thickness W and the height H of the teeth 12 measured from the base of the circumferential grooves 22 should be in the range of 0.60–0.72.

As shown in FIGS. 2 and 3, the height G of the teeth 12 from the base of the axial grooves 23 is approximately 0.75–0.80 times the height H of the grooves measured from the base of the circumferential grooves 22.

Figure 6:
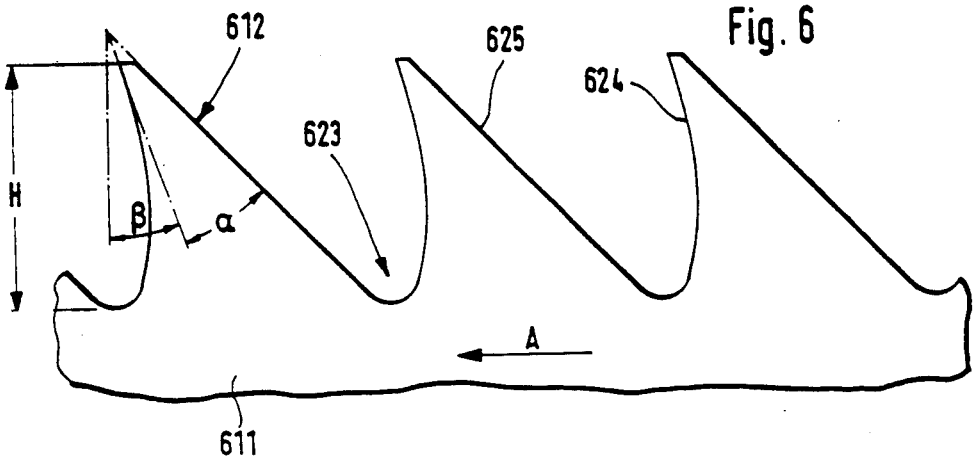
FIG. 6 is an enlarged partial sectional view of several teeth arranged behind one another and where the teeth have a tooth face that is concave with respect to the rotational direction in accordance with certain preferred embodiments of the present invention.

In the embodiment according to FIG. 6, a relatively small vertical and opposite angle $\alpha$ of 15° to 33° is provided for the teeth 612. THe rear faces 625 extend in a straight line. The front faces 624 in axial view have an arched concave contour. In the area of the tips of the teeth, a face angle $\beta$ of 12° to 25° is maintained. The radius of the concave contour decreases from the tips of the teeth, to the base of the groove of the recesses 623 so that a continuously concavely bent arch is created, the radius of which is smallest at the base of the tooth. This results in the advantage that, when such an opening roller is operated, the fibers taken along by the teeth 612 can slide toward the outside to the tips of the teeth 612 which is advantageous for the opening process and also results in a longer service life of the fitting ring 611.

Figure 7:
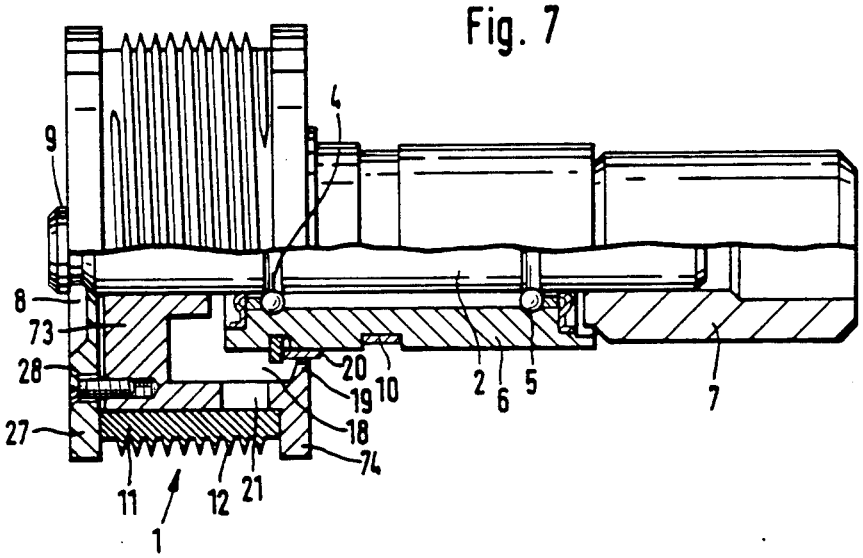
FIG. 7 is a side view of an opening roller similar to FIG. 1 and cut in half wherein the fitting ring is protected by and clamped to a ring disk that is mounted at the front side of the roller body in accordance with certain preferred embodiments of the present invention.

The embodiment according to FIG. 7 deviates from the embodiment according to FIG. 1 essentially in the fastening of the fitting ring 11 on the roller body 73. In the embodiment according to FIG. 7, the roller body 73 is pot-shaped, this shape being open in the direction of the wharve 7 arranged on the shaft 2. The base or the front side of the pot-shaped roller body 73 is provided with a centric projection having a bore by means of which the roller body 73 is pressed onto the shaft 2. The fitting ring 11 projects slightly beyond the roller body 73 in the direction away from the wharve 7, so that the fitting ring 11 projects slightly beyond the front side of the roller body 73. A ring disk 27, by means of screws 28 that are distributed evenly over the circumference, is fastened at the front side of the roller body 73. The screws 28 are screwed into threaded bores of the roller body 73. The ring disk 27, which forms a collar projecting above the teeth 12 in the radial direction, clamps in the fitting ring 11 against the opposing collar 72 that is developed in one piece with the roller body 73 so that the fitting ring 11 is held securely. In this embodiment, the fitting ring 11 is pushed onto the roller body 73 with a relatively light sliding fit.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. An opening assembly for an open-end spinning arrangement comprising:

steel alloy fitting ring means arranged on a rotatable roller body means for opening up a sliver into individual fibers, said fitting ring means including a base wall having a radial thickness no greater than 2.2 mm and including a plurality of radially extending teeth unitary with said fitting ring means extending from said base wall, said teeth having tip portions and base portions;

said teeth having lateral flanks being formed by at least one circumferential groove on at least a portion of an outer surface of said fitting ring means and having front and back edges being formed by at least two axially extending axial grooves extending across at least a portion of said at least one circumferential groove;

said front and back edges having a radial height of about 0.75–0.80 times a radial height of said lateral flanks, said base wall radial thickness having a dimension of about 0.60–0.72 times said radial height of said lateral flanks; and said teeth being separated axially between said lateral flanks by a distance and exhibiting a height, said height being greater than said distance, said fitting ring exhibiting a rotational direction when said opening assembly is operational, said teeth being inclined toward said rotational direction, said teeth having an angle between said front and back edges between about 15 degrees to 45 degrees.

2. Device as in claim 1, wherein said teeth have an axial base width at a base area of said at least one circumferential groove no greater than 0.7 mm.

3. Device as in claim 1, wherein said teeth have an axial base width at a base area of said at least one circumferential groove, said at least one circumferential groove having an axial base width about 2.5 to 3.5 times greater than said teeth axial base width.

4. Device as in claim 3, wherein said base width of said teeth is no greater than 0.7 mm.

5. Device as in claim 1, further including an opening roller body means for holding said fitting ring means, said opening roller body means being rotatable by a shaft connected to said opening roller body means.

6. Device as in claim 5, further including collar means mounted on said opening collar body means for protecting said teeth, said collar means extending radially outward at least as far as said tip portions of said teeth on said fitting ring means.

7. Device as in claim 6, further including sleeve means detachably mounted on said roller body means said fitting ring means being attachable to said sleeve means, said sleeve means being attached to said collar means.

8. Device as in claim 7, wherein said sleeve means is integral with at least a portion of said collar means.

9. Device as in claim 8, wherein said sleeve means is slidably engageable with said roller body, said sleeve means including a first end portion and a seocnd end portion;

said fitting ring means being cylindrically shaped and being slidably disposed over said sleeve means; and said collar means including a first collar means being integral with said first end portion of said sleeve menas and including a second collar means being reversibly engageable with said second end portion of said sleeve means for securing said fitting ring means onto said sleeve means.

10. Device as in claim 7, wherein said collar means forms a structural unit with said fitting ring means, said structural unit being mountable on said roller body means.

11. Device as in claim 7, wherein said fitting ring means include axial recesses and said collar means include sleeve-like projections, said sleeve-like projections being insertable in said recesses.

12. Device as in claim 11, wherein said collar means including said sleeve-like projections are formed as sheet-metal preforms.

13. Device as in claim 1, wherein said angle between said front and back edges is about 20° to 33°.

14. Device as in claim 1, wherein each of said front edges of said teeth exhibit a front angle defined by each of said front edges of said teeth and a radial plane extending through an axis of said fitting ring means, said front angle being no greater than 25°.

15. Device as in claim 14, wherein said front angle is about 12° to 25°.

16. Device as in claim 1, wherein said front edges of said teeth includes a concave face with respect to said rotational direction.

17. Device as in claim 16, wherein said concave face has a larger radius of curvature at said tip portion of said teeth than at said base portion of said teeth.

18. Device as in claim 17, wherein said concave face has a radius of curvature which decreases continuously from said tip portion of said teeth to said base portion of said teeth.

19. Device as in claim 1, wherein said height of said teeth is about 1.2–1.7 times greater than said axial separation distance.

20. Device as in claim 1, wherein said steel alloy material of said fitting ring means is hardened to a hardness of about HRc 60+3.

21. Device as in claim 1, wherein said fitting ring means includes a surface coating.

22. Device as in claim 21, wherein said surface coating is disposed on said teeth.

23. Device as in claim 1, further including surface coating means on said teeth for improving wear characteristics.

24. Device as in claim 1, wherein said front edges, said tip portion and said back edges include a convex rounded edge having a radius of curvature with respect to a radial plane extending through said teeth.

25. Device as in claim 24, wherein said rounded edge has a radius of curvature of about 0.02 mm to 0.06 mm.

26. Device as in claim 25, wherein said rounded edge has a radius of curvature of about 0.04 mm.

* * * * *